US009487009B2

(12) United States Patent
Tajima

(10) Patent No.: US 9,487,009 B2
(45) Date of Patent: Nov. 8, 2016

(54) METHOD FOR MANUFACTURING LIQUID EJECTION HEAD

(71) Applicant: CANON KABUSHIKI KAISHA, Tokyo (JP)

(72) Inventor: Hiroki Tajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/613,733

(22) Filed: Feb. 4, 2015

(65) Prior Publication Data

US 2015/0224773 A1 Aug. 13, 2015

(30) Foreign Application Priority Data

Feb. 10, 2014 (JP) ..... 2014-023562

(51) Int. Cl.

*B21D 53/00* (2006.01)
*B41J 2/16* (2006.01)
*B41J 2/155* (2006.01)

(52) U.S. Cl.

CPC ..... *B41J 2/1632* (2013.01); *B41J 2/155* (2013.01); *B41J 2/1603* (2013.01); *B41J 2/1623* (2013.01); *B41J 2202/20* (2013.01); *Y10T 29/49401* (2015.01)

(58) Field of Classification Search

CPC ..... B41J 2002/14491; B41J 2002/14217; B41J 2002/14225; B41J 2002/14306; B41J 2002/14362; B41J 2002/14379; B41J 2202/11; B41J 29/38; B41J 29/393; B41J 2/04521; B41J 2/04541; B41J 2/04545; B41J 2/04573; B41J 2/0458; B41J 2/04598; Y10T 29/49004; Y10T 29/49401

USPC ..... 29/593, 890.1; 347/54, 68, 69, 70, 71, 347/72

See application file for complete search history.

(56) References Cited

U.S. PATENT DOCUMENTS

| | | | | |
|---|---|---|---|---|
| 6,659,591 | B2 * | 12/2003 | Sato et al. | 347/50 |
| 7,296,877 | B2 * | 11/2007 | Chikuma et al. | 347/41 |
| 7,984,549 | B2 * | 7/2011 | Osaki | 29/890.1 |
| 8,141,988 | B2 | 3/2012 | Hirosawa | |
| 8,851,660 | B2 * | 10/2014 | Furukawa | 347/104 |

FOREIGN PATENT DOCUMENTS

JP 2010-023486 A 2/2010

* cited by examiner

*Primary Examiner* — Paul D Kim

(74) *Attorney, Agent, or Firm* — Fitzpatrick, Cella, Harper & Scinto

(57) ABSTRACT

There is provided a method for manufacturing a liquid ejection head comprising a base plate that is provided with supply slits, and an element substrate that is jointed to the base plate and is provided with supply openings. In a case where a shift amount between a position of the supply opening and a position of the supply slit is a predetermined value or more, the element substrate is corrected in position such that the shift amount is less than the predetermined value, and a position of the element substrate is corrected by an integral multiple of an image formation minimum pixel pitch in a sheet conveying direction, of an image formed on a sheet, as a unit of a travel distance at the correcting of the element substrate.

5 Claims, 11 Drawing Sheets

POSITIONAL SHIFT AMOUNT OF A CENTER LINE :
HALF OR LESS OF A SLIT WIDTH

POSITIONAL SHIFT AMOUNT OF A CENTER LINE:
HALF OR MORE OF A SLIT WIDTH

POSITIONAL SHIFT AMOUNT OF A CENTER LINE:
HALF OR LESS OF A SLIT WIDTH

POSITIONAL SHIFT AMOUNT OF A CENTER LINE:
HALF OR MORE OF A SLIT WIDTH

METHOD FOR MANUFACTURING LIQUID EJECTION HEAD

BACKGROUND OF THE INVENTION

1. Field of the Invention

The present invention relates to a method for manufacturing a liquid ejection head composed of a line head in which element substrates provided with liquid supply openings are arranged in a direction crossing a sheet conveying direction on a base plate on which liquid supply slits are formed, for correcting a position of the liquid supply opening to the liquid supply slit, and the liquid ejection head.

2. Description of the Related Art

In general, in a liquid ejection head in which a plurality of element substrates are arranged, the element substrate is positioned and fixed on a support member (base plate) made of aluminum, resin or the like in such manner as to arrange the element substrate in a predetermined position at the time of attaching the liquid ejection head to a liquid ejection apparatus. In this way, there is used a line head in which ejection is made possible on a sheet over an entire region of a sheet width by arranging the element substrates, which are thus positioned and fixed on the base plate, in a zigzag manner. In a case of the liquid ejection head in which such element substrates are arranged on the base plate in a zigzag manner, each of the element substrates is positioned and fixed on the base plate on which liquid supply slits for supplying liquids to the element substrates are each arranged in a predetermined position.

At this time, two lines of the liquid supply slits in the base plate each are linearly formed at an interval in a direction vertical to a sheet conveying direction, and the plurality of element substrates are attached in predetermined positions on the base plate for fixation. Accordingly a position of a liquid supply opening disposed on the element substrate is designed to be adjusted to a predetermined position to a position of the liquid supply slit of the base plate.

However, in a case of an elongated liquid ejection head as the line head, a strain is possibly generated in the base plate, and therefore there are some cases where the position of the liquid supply opening provided on the element substrate does not match the position of the liquid supply slit in the base plate.

Therefore according to Japanese Patent Laid-Open No. 2010-23486, the ink supply member that will be attached to the base plate is divided into a plurality of ink supply members in view of the event that attachment between members different from each other is one cause of generation of the base plate strain, and thus the strain of the base plate is reduced.

The generation of the strain in the base plate is caused not only by the attachment of the different members to each other. In a case of the line head that can eject liquids over an entire region of the sheet in A4 size in the width direction, the base plate having a length of approximately 300 to 400 mm is used. In a case where the base plate of such a length is formed of an aluminum sintered body, a curved warp is generated in the base plate. In regard to an outline of the base plate in which the warp is thus generated, a deformed amount thereof can be removed by cutting work or the like, but in regard to the positions of the plurality of liquid supply slits formed on the base plate, the positional shift of each becomes the larger in the sheet conveying direction from both the ends toward the center of the base plate.

FIG. 11 is a diagram showing element substrates and a base plate according to the conventional technology. When a plurality of element substrates each are, as shown in FIG. 11, attached and fixed on the base plate in a predetermined position to line up in a straight line, the position of the liquid supply slit of the base plate is shifted largely in the sheet conveying direction from that of the liquid supply opening of the element substrate in the position where the base plate is deformed in a curved shape.

As a result, there are some cases where an opening width of the liquid supply opening of the element substrate is made small. Therefore a refill failure in which liquids are not sufficiently supplied occurs, an adherent for attaching and fixing the element substrate flows into the liquid supply slit, and in the worst case, the liquid supply opening of the element substrate is closed up by the base plate. Therefore the base plate the entirety of which is deformed in a curved shape and in which the liquid supply slit position is out of a predetermined dimension cannot be used, leading to a reduction in production yield rate of the base plate, that is, a cost increase in production thereof.

SUMMARY OF THE INVENTION

Therefore, the present invention is made for solving the foregoing problems in the conventional technology, and an object of the present invention is to provide a method for manufacturing a liquid ejection head and a liquid ejection head, which can prevent deterioration in production yield rate of the liquid ejection head to decrease the production cost.

Therefore, a method for manufacturing a liquid ejection head according to an aspect of the present invention including a joint step for jointing a base plate provided with a plurality of supply slits each arranged in a predetermined position and an element substrate provided with a plurality of supply openings each arranged to be adjusted to the predetermined position, comprises an obtaining step for obtaining information in regard to a shift amount between the position of the supply opening and the position of the supply slit at the time of jointing the element substrate and the base plate, a correcting step for, in a case where the information in regard to the shift amount between the position of the supply opening and the position of the supply slit is a predetermined value or more, correcting the element substrate from the predetermined position such that the information in regard to the shift amount is less than the predetermined value, and a position correcting step for correcting the position of the element substrate by an the integral multiple of an image formation minimum pixel pitch in a conveying direction of a sheet, of an image formed on the sheet by liquids ejected from the liquid ejection head, as a unit of a travel distance at the correcting of the element substrate.

According to the aspect of the present invention, it is possible to realize the method for manufacturing the liquid ejection head that can prevent deterioration in production yield rate of the liquid ejection head at the manufacturing to decrease the production cost by adjusting the position of the supply opening in the element substrate to the position of the supply slit in the base plate.

Further features of the present invention will become apparent from the following description of exemplary embodiments (with reference to the attached drawings).

DESCRIPTION OF THE EMBODIMENTS

First Embodiment

Hereinafter, a first embodiment of the present invention will be in detail explained with reference to the attached drawings. FIGS. 1A to 1C, FIG. 2A, FIG. 2B and FIG. 3 are explanatory diagrams explaining each of a preferred liquid ejection head and a preferred liquid ejection apparatus to which embodiments of the present invention are carried out or applied and a relationship of them. Hereinafter, each of the components in the liquid ejection head and the liquid ejection apparatus will be explained with reference to the attached drawings.

(Explanation of Liquid Ejection Head)

Figure 1A:
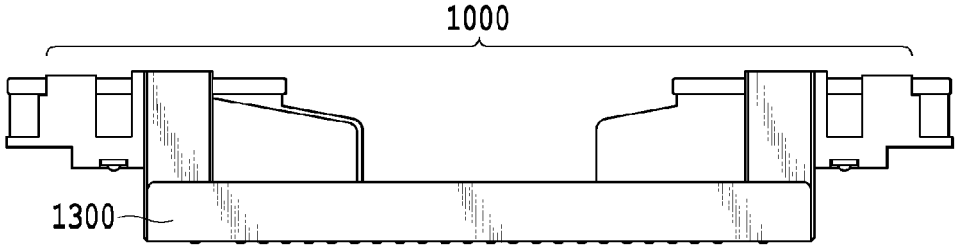
FIG. 1A is a diagram showing a liquid ejection head according to embodiments of the present invention.
Figure 1B:
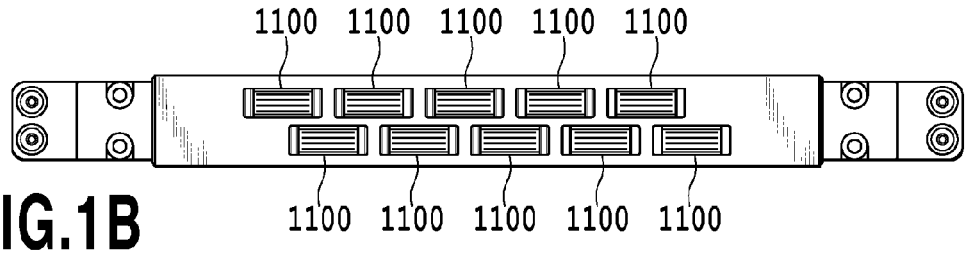
FIG. 1B is a diagram showing the liquid ejection head according to the embodiments.
Figure 1C:
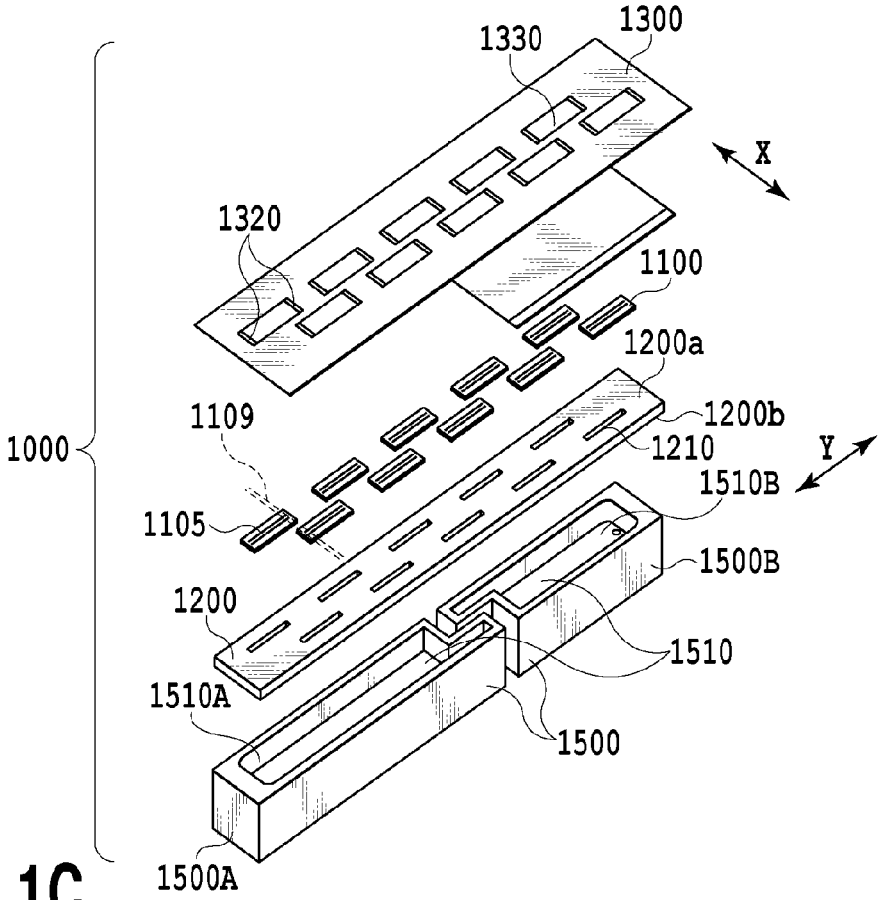
FIG. 1C is a diagram showing the liquid ejection head according to the embodiments.

A liquid ejection head 1000 to which the embodiments of the present invention are applied is provided with an ejection opening line formed therein to cover a range of the maximum width of a sheet supposed to be used, and is a full line type liquid ejection head of an inkjet method that can perform a print in a wide range without the scanning of the liquid ejection head 1000. FIG. 1A to FIG. 1C are diagrams explaining the liquid ejection head to which the embodiments of the present invention are applicable. FIG. 1A is a front view showing the liquid ejection head 1000, FIG. 1B is a bottom view showing the liquid ejection head 1000, and FIG. 1C is an exploded perspective view showing components of the liquid ejection head 1000.

The liquid ejection head 1000 includes a plurality of element substrates 1100, a base plate 1200 for supporting the element substrates 1100, an electrical wiring substrate 1300 for electrical connection between the element substrates 1100 and the liquid ejection apparatus, and ink supply members 1500 jointed to the base plate 1200. The plurality of element substrates 1100 are arranged in a direction (arrow Y direction) crossing a sheet conveying direction (arrow X direction) on a main surface 1200*a* of the base plate 1200 with excellent accuracy, and the ink supply members 1500 are arranged on a surface 1200*b* of the base plate 1200 at the opposite side to the main surface 1200*a*.

Figure 2A:
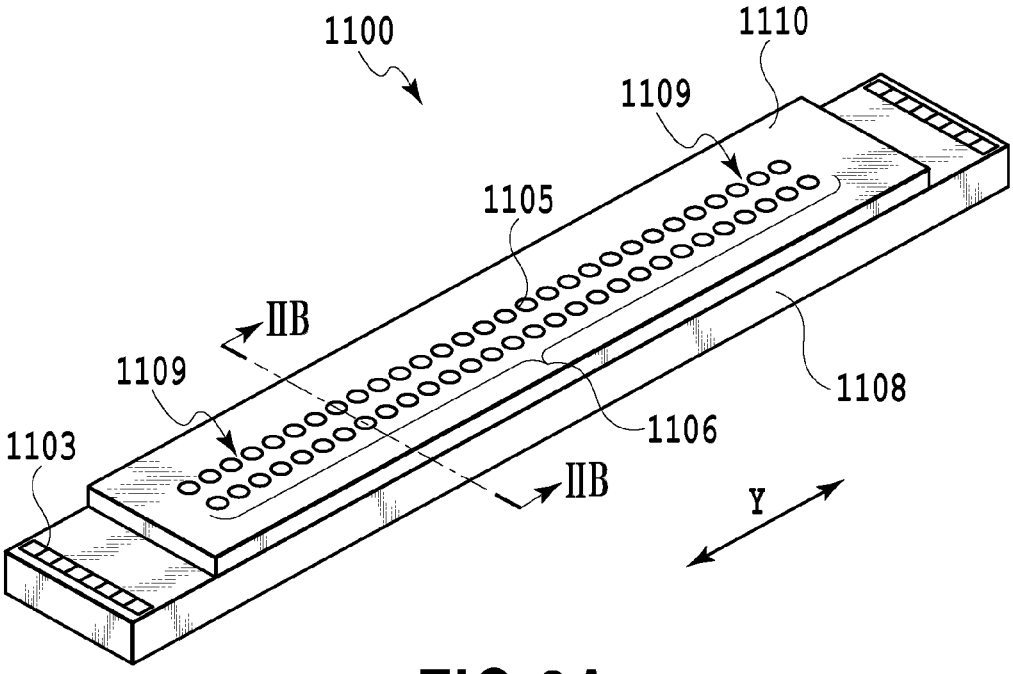
FIG. 2A is a diagram showing an element substrate according to the embodiments.
Figure 2B:
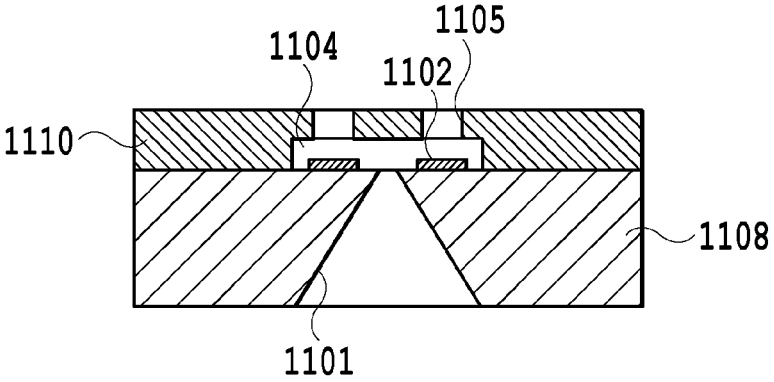
FIG. 2B is a diagram showing the element substrate according to the embodiments.

Next, an explanation will be made of the element substrate 1100 having an ejection opening group for ejecting liquids (hereinafter, referred to as "ink" also). FIG. 2A and FIG. 2B are diagrams each showing the detailed configuration of the element substrate 1100 shown in FIG. 1A. The element substrate 1100 is provided with an ink supply opening 1101 formed in an Si substrate 1108 having a thickness of 0.5 to 1 mm, for example, the ink supply opening 1101 being composed of a through hole in an elongated groove shape as an ink flow passage. In a joint face between the Si substrate 1108 and an ejection opening plate 1110 to be described later, heat generation resistance elements 1102 are arranged in a line at each of both sides of the ink supply opening 1101 in a zigzag shape, and the heat generation resistance element 1102 and the electrical wiring made of aluminum or the like are formed by deposition techniques.

A plurality of electrodes 1103 are provided at both ends of the Si substrate 1108 in an arrow Y direction for supplying electrical power to the electrical wiring. Further, the ejection opening plate 1110 is provided on the Si substrate 1108, and an ink flow passage 1104 and ejection openings 1105 corresponding to the heat generation resistance elements 1102 are formed in the ejection opening plate 1110 by a photolithographic technique. The ejection opening 1105 is provided to face the heat generation resistance element 1102, and air bubbles are generated from ink supplied from the ink supply opening 1101 by the heat generation resistance element 1102 to eject the ink.

The base plate 1200 for supporting the element substrate 1100 as shown in FIG. 1C is formed of an aluminum laminated plate having a thickness of approximately 10 mm formed by laminating and burning aluminum green sheets each having a thickness of 0.5 to 1 mm, for example. Ink supply slits 1210 are formed in the base plate 1200 to supply ink to the respective element substrates 1100. It should be noted that a material of the base plate 1200 is not limited to the aluminum, and may be a ceramic material or resin material having a linear expansion coefficient equivalent to that of a material of the element substrate 1100.

The base plate 1200 is provided with the element substrates 1100 each arranged in a zigzag shape with a predetermined position accuracy. The respective element substrates 1100 are arranged such that end portions 1109 of the ejection opening groups 1106 provided in the respective element substrates 1100 overlap with each other in an ejection opening arrangement direction. In this manner, in the joint portion between the element substrates 1100, the end portions 1109 of the ejection opening groups are arranged to overlap with each other. Therefore also in the elongated liquid ejection head, the ejection openings 1105 can be sequentially arranged in the longitudinal direction, and an influence on the image generated at the printing by a positional shift at the arranging or the like can be corrected.

(Explanation of Liquid Ejection Apparatus)

Figure 3:
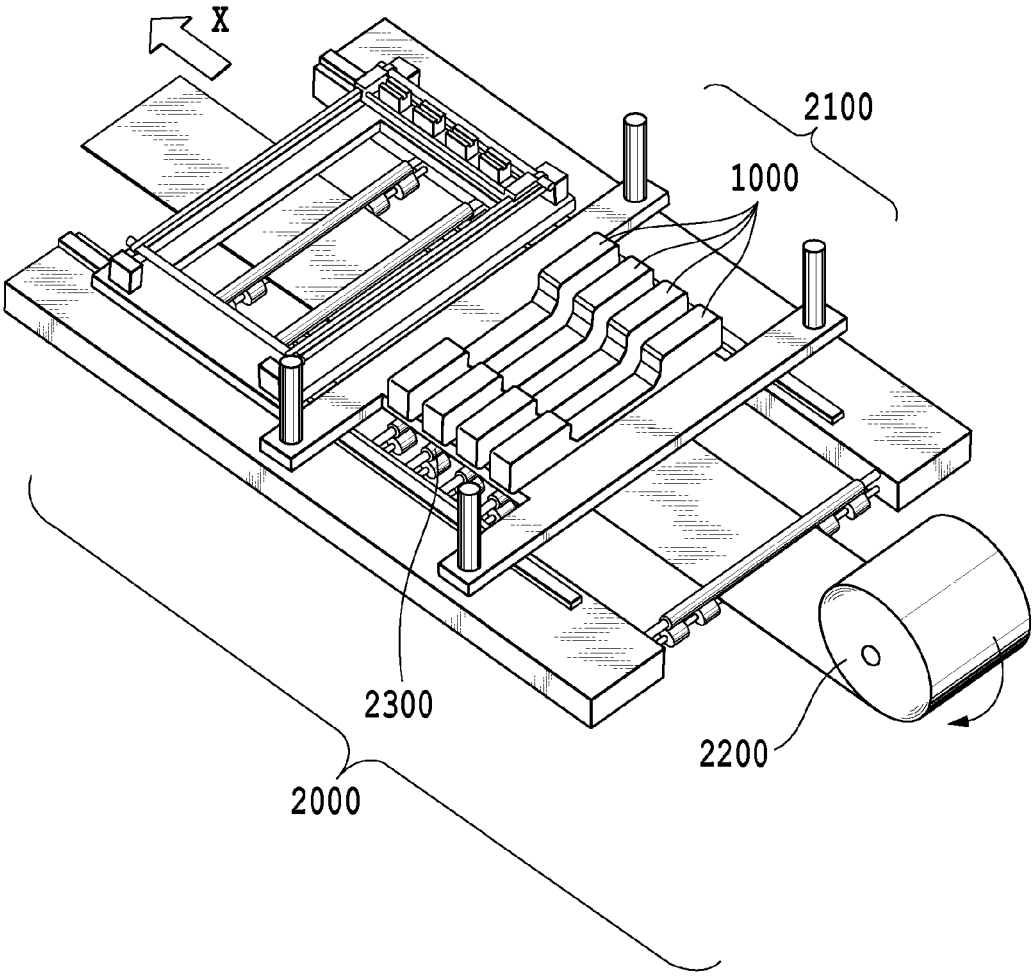
FIG. 3 is a diagram showing a liquid ejection apparatus according to the embodiments.

FIG. 3 is a perspective view showing a major portion of a liquid ejection apparatus 2000 on which the liquid ejection head 1000 according to embodiments of the present invention is mounted. The liquid ejection apparatus 2000 is a line printer that uses an elongated full line type liquid ejection head to print while sequentially conveying sheets in a conveying direction (arrow X direction). The liquid ejection apparatus 2000 includes a holder for holding a sheet 2200 such as a continuous sheet wound in a roll shape, a conveying mechanism 2300 for conveying the sheet 2200 in the arrow X direction at a predetermined speed, and a print unit 2100 for printing on the sheet 2200 by the liquid ejection head 1000.

It should be noted that the sheet is not limited to the roll sheet, but may be a cut sheet. Further, the liquid ejection apparatus 2000 is provided with a sub-tank (not shown) for accumulating ink to be supplied to the liquid ejection apparatus 2000. Further, the liquid ejection apparatus 2000 is provided with an ink flow passage, ink accommodated in the sub-tank is supplied to the liquid ejection head 1000, and the ink is recirculated from the liquid ejection head 1000 to the sub-tank through the ink flow passage.

The print unit 2100 is provided with the plurality of liquid ejection heads 1000 each corresponding to a different ink color. In the present embodiment, the liquid ejection heads 1000 comprise four liquid ejection heads corresponding to four colors of cyan C, magenta M, yellow Y and black K, but the numbers of colors may comprise any numbers.

Figure 4A:
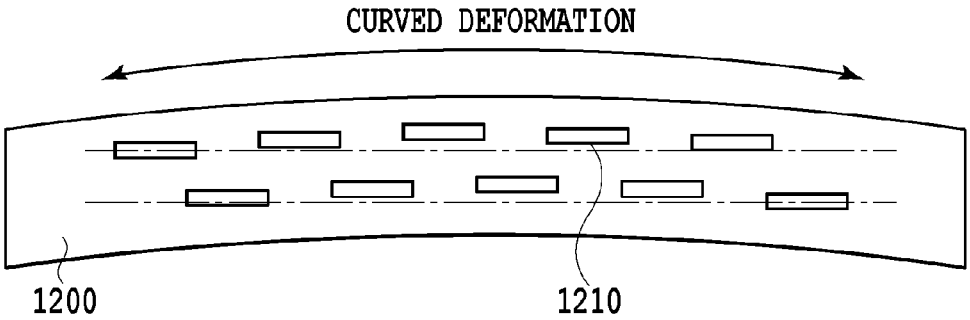
FIG. 4A is a plan view showing a base plate according to a first embodiment of the present invention.
Figure 4B:
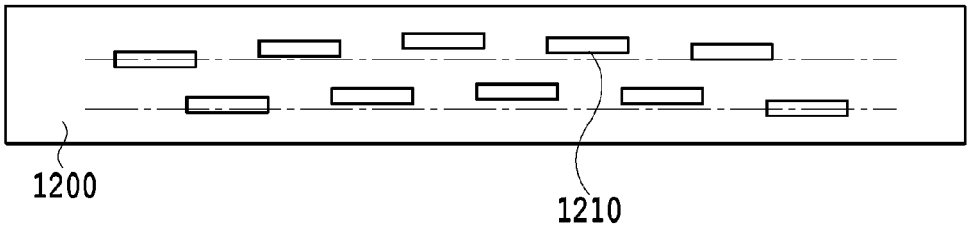
FIG. 4B is a plan view showing the base plate according to the first embodiment.
Figure 5A:
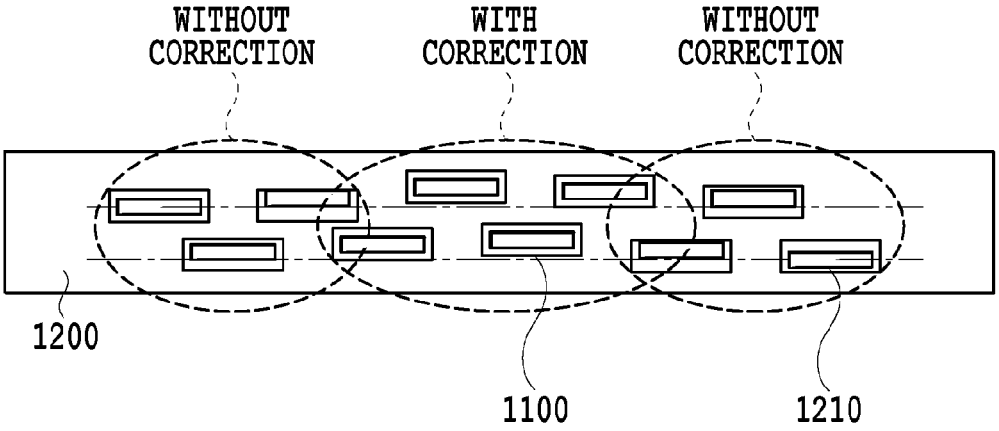
FIG. 5A is a plan view showing element substrates according to the first embodiment.
Figure 5B:
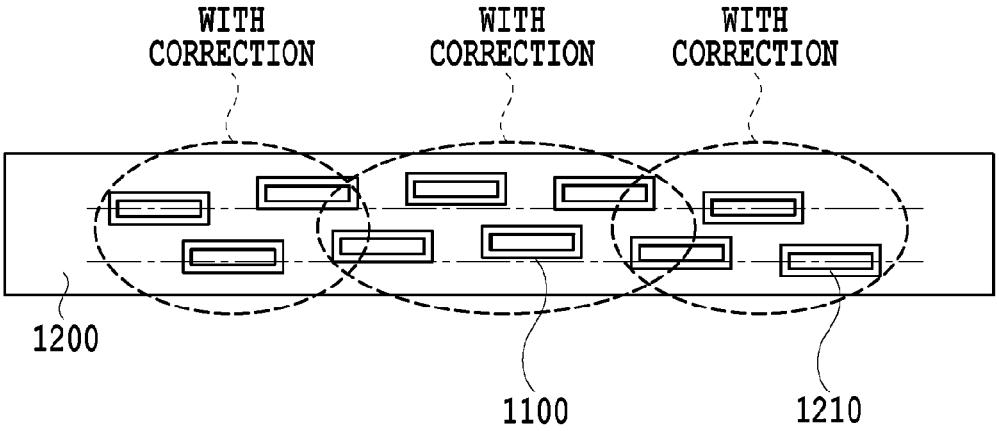
FIG. 5B is a plan view showing the element substrates according to the first embodiment.

FIG. 4A and FIG. 4B are plan views each showing the base plate 1200 used in the present embodiment. FIG. 5A and FIG. 5B are diagrams each showing the arrangement state of the element substrates 1100 in the present embodiment. In the present embodiment, in a case where the ink supply slits 1210 are arranged in a curved shape by the warping of the base plate 1200, the position of the ink supply slit 1210 is adjusted to the ink supply opening 1101 of the element substrate 1100, and then the element substrate 1100 is attached and fixed to the base plate 1200.

In the manufacture, the image processing technique is first used to measure the positional shift in the sheet conveying direction between the ink supply opening 1101 of the element substrate 1100 arranged on the base plate 1200 and the ink supply slit 1210 of the base plate 1200 (information in regard to the shift amount is obtained). At this time, the position of the ink supply opening 1101 in the element substrate 1100 is measured from a substantially central line of the ink supply opening 1101 in a direction vertical, i.e., perpendicular, to the sheet conveying direction. In addition, the position of the ink supply slit 1210 in the base plate 1200 is measured from a substantially central line of the ink supply slit 1210 in a direction vertical to the sheet conveying direction.

In a case where the element substrate 1100 is arranged on the base plate 1200 in a state where the shift amount in the sheet conveying direction between the ink supply opening 1101 and the ink supply slit 1201 is less than a half of a width dimension of the ink supply slit 1201 in the short direction (less than a predetermined value), the element substrate 1100 is arranged in a predetermined position without its positional correction. In addition, in a case where the element substrate 1100 is arranged on the base plate 1200 in a state where the shift amount in the sheet conveying direction between the ink supply opening 1101 and the ink supply slit 1201 is a half or more of the width dimension of the ink supply slit 1201 in the short direction (the predetermined value or more), the element substrate 1100 is arranged on the base plate 1200 by adjusting the ink supply opening 1101 to the position of the ink supply slit 1201 for its positional correction.

Specifically the element substrate 1100 is arranged on the base plate 1200 such that a substantially central line of the ink supply opening 1101 in a direction vertical to the sheet conveying direction is substantially in agreement with a substantially central line of the ink supply slit 1210 in a direction vertical to the sheet conveying direction. By arranging the element substrate 1100 with this method, the ink supply opening 1101 the position of which is shifted largely from the ink supply slit 1201 in the sheet conveying direction is corrected in position to be arranged in the substantially central line of the ink supply slit 1201.

When the element substrate 1100 is thus arranged, the element substrates 1100 result in being arranged on the base plate 1200 as shown in FIG. 5A. The element substrates 1100 near both the ends of the base plate 1200 each are arranged in a predetermined position, and the element substrate 1100 near the center thereof is corrected to be arranged in the center of the ink supply slit 1210.

It should be noted that if a production tact time at the manufacturing process is permitted, even when the element substrate 1100 is arranged in a state where the shift amount in the sheet conveying direction between the ink supply opening 1101 and the ink supply slit 1201 is less than a half of the width dimension of the ink supply slit 1201 in the short direction, the element substrate 1100 may be corrected in position in such a manner that the center lines of the ink supply opening 1101 and the ink supply slit 1201 are substantially in agreement with each other. As a result, the element substrates 1100 are arranged on the base plate 1200 as shown in FIG. 5B, wherein every ink supply opening 1101 is in the form of being arranged in the center of the ink supply slit 1210.

Figure 6A:
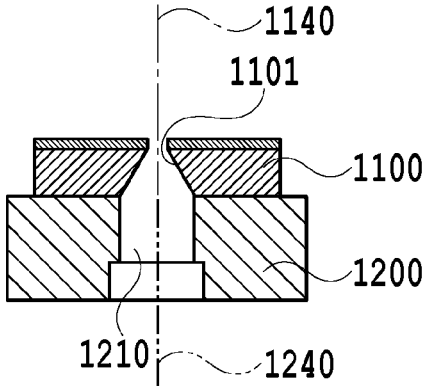
FIGS. 6A to 6C are cross sections each showing an element substrate and a base plate according to a conventional method.
Figure 6B:
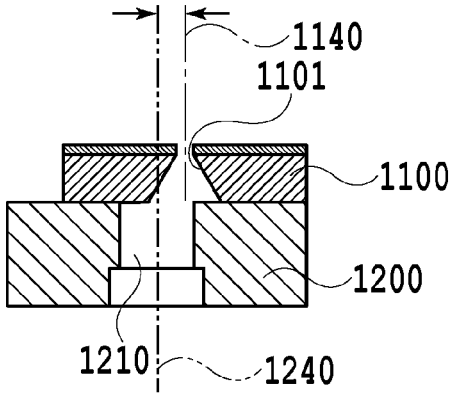
Figure 6C:
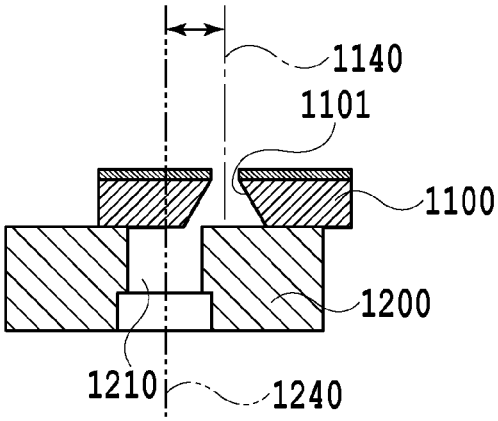
Figure 11:
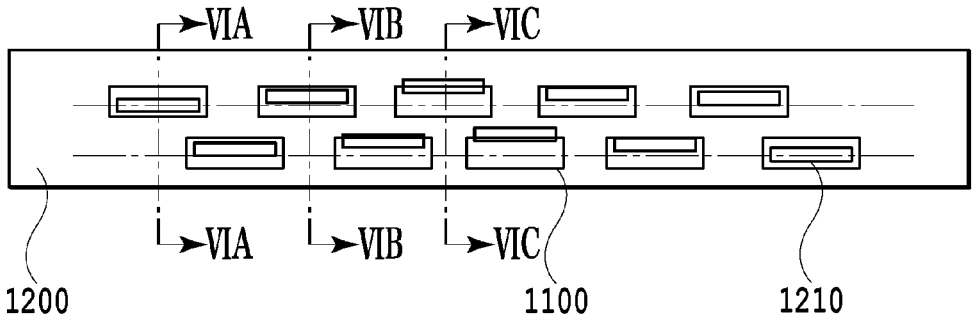
FIG.11 PRIOR ART
FIG. 11 is a diagram showing element substrates and a base plate according to the conventional method.

FIG. 6A to FIG. 6C are cross sections each showing the element substrate 1100 arranged and fixed on the base plate 1200 by the conventional method, taken in the sheet conveying direction FIG. 6A is a cross section taken in a direction of arrows VIA-VIA in FIG. 11. In this arrangement of the element substrate 1100 to the base plate 1200, the element substrate 1100 is arranged on the base plate 1200 substantially with no positional shift in the sheet conveying direction in the position relation between the ink supply opening 1101 of the element substrate 1100 and the ink supply slit 1210 of the base plate 1200. In addition, FIG. 6B is a cross section taken in a direction of arrows VIB-VIB in FIG. 11. In this arrangement of the element substrate 1100 to the base plate 1200, the ink supply opening 1101 of the element substrate 1100 is positioned to be shifted in the sheet conveying direction from the ink supply slit 1210 of the base plate 1200.

However, since the opening width of the ink supply slit 1210 is a half or more of the width of itself, a possibility of causing a print failure such as deterioration of ink supply performance or attachment reliability of the element substrate 1100 is extremely low. FIG. 6C is a cross section taken in a direction of arrows VIC-VIC in FIG. 11. In this arrangement of the element substrate 1100 to the base plate 1200, the ink supply opening 1101 of the element substrate 1100 is positioned to be largely shifted in the sheet conveying direction from the ink supply slit 1210 of the base plate 1200, and the opening width of the ink supply slit 1210 is less than a half of the width of itself. In this arrangement state, there is an extremely high possibility of causing a print failure due to lack of ink supply amount to the element substrate 1100, separation of the element substrate 1100 from the base plate 1200, and the like.

Therefore the present embodiment adopts the method where in a case where the ink supply opening 1101 and the ink supply slit 1201 are largely shifted in position from each other as described above, the position of the element substrate 1100 is corrected to the base plate 1200 to arrange the element substrate 1100 thereon. With this correction, the element substrate 1100 arranged to be adjusted (corrected) to the position of the ink supply slit 1201 can form a predetermined image by changing drive timing to the element substrate 1100 arranged in a predetermined position without its positional correction.

Therefore, in a case where the position of the element substrate 1100 is corrected to be arranged to be adjusted to the position of the ink supply slit 1201, the element substrate 1100 may be arranged in a position shifted by an integral multiple of an image formation minimum pixel pitch in the sheet conveying direction (the travel distance is equal to an integral multiple of an image formation minimum pixel pitch), from the predetermined arrangement position of the element substrate 1100. That is, for example, in a case where an image in the sheet conveying direction has a resolution of 1200 dpi, since the image formation minimum pixel pitch is 21.2 μm, the element substrates 1100 each may be arranged in a unit of 21.2 μm.

A width dimension of the ink supply slit 1201 is approximately 0.5 to 1 mm. When this accuracy is maintained, even in a case where the element substrate 1100 is arranged in the position of the ink supply slit 1201, the shift amount in the sheet conveying direction between the ink supply opening 1101 and the ink supply slit 1201 can be made less than a half of the width dimension of the ink supply slit 1201.

Therefore according to the manufacturing method by the present embodiment of the present invention, even when the base plate 1200 is warped in a curved shape to cause the ink supply slit 1210 to be arranged in a curved shape, the ink supply can be securely made without a positional shift between the ink supply slit 1210 and the ink supply opening 1101 of the element substrate 1100 to manufacture a highly reliable liquid ejection head.

With this configuration, it is possible to realize the method for manufacturing the liquid ejection head that can prevent deterioration in production yield rate at the manufacturing of the liquid ejection head to decrease the production cost.

Second Embodiment

Hereinafter, an explanation will be made of a method for manufacturing a liquid ejection head according to a second embodiment of the present invention. It should be noted that since a basic configuration of the present embodiment is the same as that of the first embodiment, hereinafter only a characteristic configuration of the present embodiment will be explained.

Figure 7A:
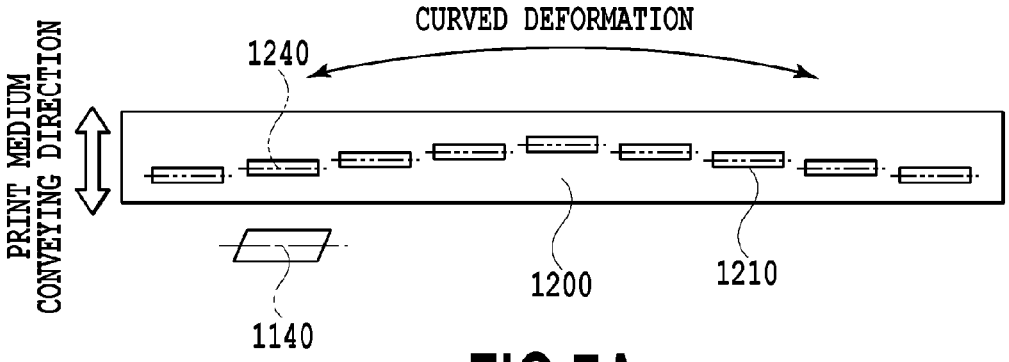
FIG. 7A is a diagram showing a base plate according to a second embodiment of the present invention.
Figure 7B:
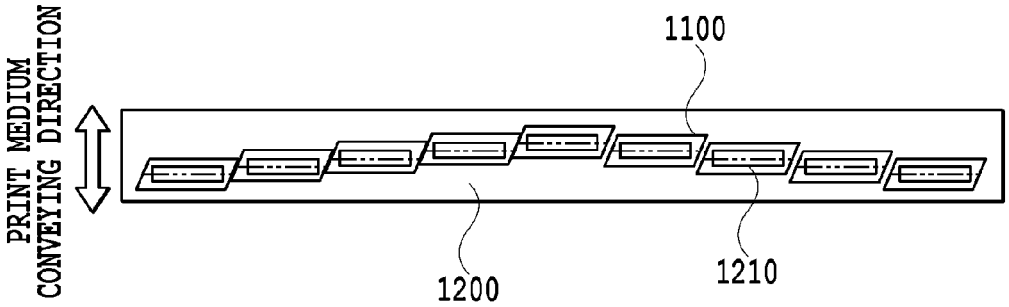
FIG. 7B is a diagram showing the base plate according to the second embodiment.

FIG. 7A and FIG. 7B are diagrams showing a base plate to which the present embodiment is applicable, wherein the respective element substrates are arranged on a straight line to downsize a dimension of the liquid ejection head in the sheet conveying direction. The element substrate 1100 used herein is made to a diamond shape formed by obliquely cutting short sides of the element substrates 1100 neighbored to each other. Therefore also when the element substrates 1100 are arranged in a line, the element substrates 1100 can be arranged such that the end portions 1109 of the ejection opening groups 1106 provided in the respective element substrates 1100 overlap with each other in the ejection opening arrangement direction.

Then, with a method similar to that of the first embodiment, each of the element substrates 1100 is arranged such that the ink supply opening 1101 and the ink supply slit 1201 are positioned to be in agreement in the sheet conveying direction. The element substrates 1100 are fine-adjusted to be positioned away from each other by an integral multiple of the image formation minimum pixel pitch in the sheet conveying direction, thus completing the attachment and fixation of the element substrate 1100. That is, according to the manufacturing method in the present embodiment of the present invention, the element substrate 1100 can be arranged following the position of the ink supply slit 1210 in the sheet conveying direction even in this arrangement. Therefore it is possible to realize the highly reliable liquid ejection head in which the positional shift between and the element substrate 1100 and the ink supply slit 1210 cannot nearly occur.

With this configuration, it is possible to realize the method for manufacturing the liquid ejection head that can prevent deterioration in production yield rate at the manufacturing of the liquid ejection head to decrease the production cost.

Third Embodiment

Hereinafter, an explanation will be made of a method for manufacturing a liquid ejection head according to a third embodiment of the present invention. It should be noted that since a basic configuration of the present embodiment is the same as that of the first embodiment, hereinafter only a characteristic configuration of the present embodiment will be explained.

Figure 8A:
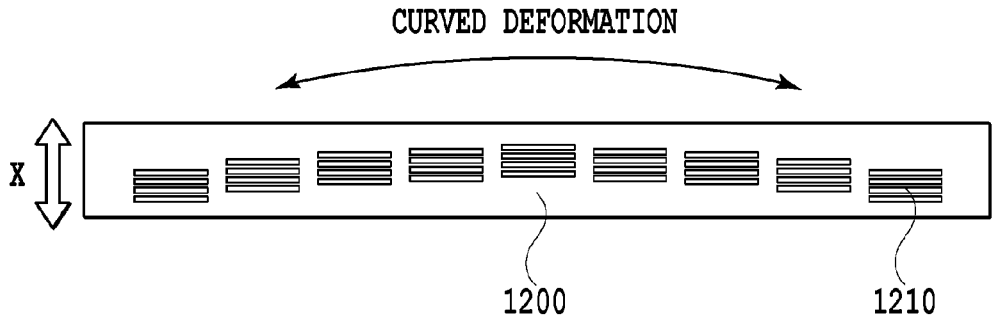
FIG. 8A is a diagram showing a base plate according to a third embodiment of the present invention.
Figure 8B:
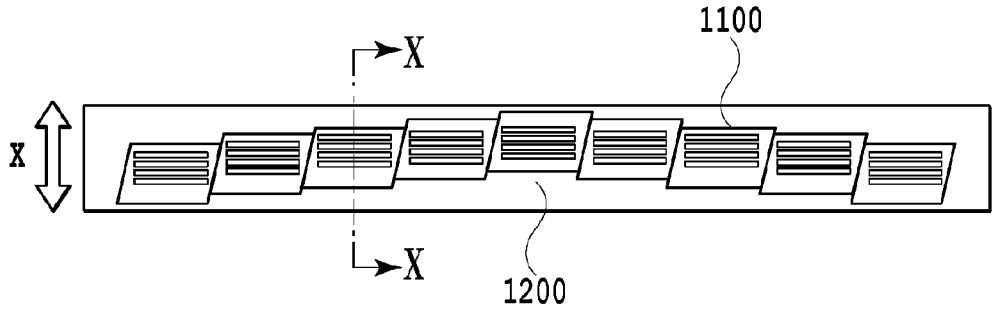
FIG. 8B is a diagram showing the base plate according to the third embodiment.

FIG. 8A and FIG. 8B are diagrams showing a base plate to which the present embodiment is applicable, and an explanation will be made of the configuration of a liquid ejection head in which a plurality of ink supply slits 1201 are formed to a single element substrate 1100, that is, the configuration of a liquid ejection head that can deal with a plurality of colors. It should be noted that in the present embodiment, as shown in FIG. 8A, the ink supply slit 1210 comprises four ink supply slits that are arranged in parallel, but may comprise any numbers of ink supply slits as needed.

Since the method for positioning the ink supply slit 1210 and the element substrate 1100 is the same as the content explained in the first embodiment and the second embodiment, herein an explanation will be made of disposition of a center line and a positional shift in a case where the ink supply slit 1210 comprises a plurality of the ink supply slits.

Figure 9A:
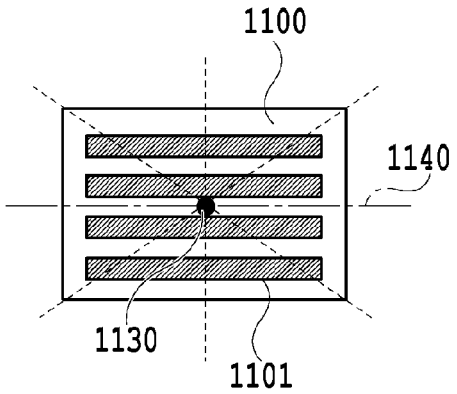
FIG. 9A is a diagram showing an ink supply slit group and the gravity center according to the third embodiment.
Figure 9B:
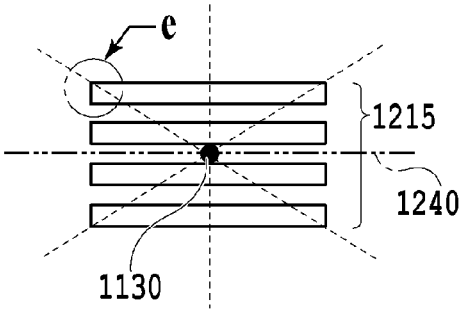
FIG. 9B is a diagram showing the ink supply slit group and the gravity center according to the third embodiment.

FIG. 9A is a diagram showing the element substrate 1100 as viewed from a surface on which an ink supply opening is formed, wherein a crossing point of two straight lines respectively connecting between four opposing corners is defined as a gravity center 1130 and a line that passes through the gravity center 1130 and is vertical to the sheet conveying direction is defined as a first center line 1140. FIG. 9B and FIG. 9C are diagrams showing the ink supply slit 1210 as viewed from a main surface of the base plate. In FIG. 9B to FIG. 9D, a set of ink supply slits corresponding to one element substrate is defined as an ink supply slit group 1215. In the ink supply slit group 1215, a crossing point of two straight lines respectively connecting between four opposing corners that are positioned in four corners of the ink supply slits positioned at both end portions is defined as a gravity center 1230 and a line that passes through the gravity center 1230 and is vertical to the sheet conveying direction is defined as a second center line 1240.

Figure 9E:
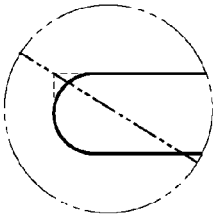
FIG. 9E is a diagram showing the ink supply slit group and the gravity center according to the third embodiment.
Figure 9C:
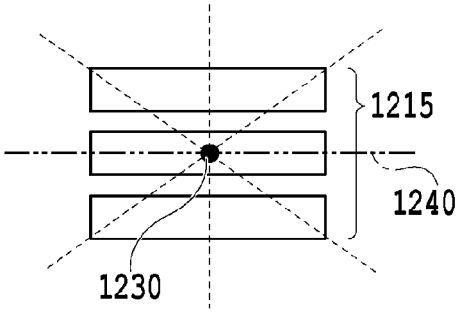
FIG. 9C is a diagram showing the ink supply slit group and the gravity center according to the third embodiment.
Figure 9D:
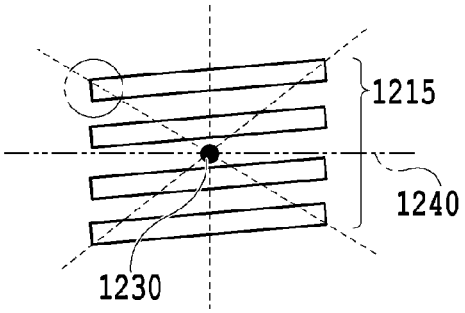
FIG. 9D is a diagram showing the ink supply slit group and the gravity center according to the third embodiment.

Here, in a case where an end portion of the ink supply slit 1210 is round, as shown in FIG. 9E (e part in FIG. 9B) a virtual vertex is drawn, which is defined as a corner portion. FIG. 9D shows a state where the ink supply slit group 1215 is inclined by deformation or the like, but since a relationship between the gravity center 1230 and the second center line 1240 does not change, there are some cases where the ink supply slit 1210 and the second center line 1240 are not in parallel to each other.

Next, an explanation will be made of a positional shift in the sheet conveying direction between the ink supply slit 1210 and the ink supply opening 1101.

Figure 10A:
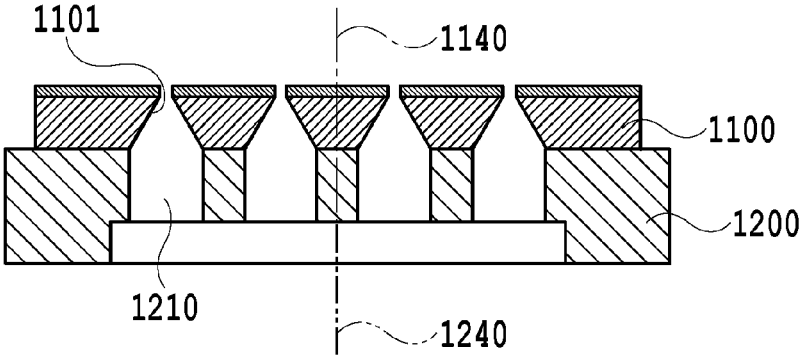
FIG.10A PRIOR ART
FIG. 10A is a cross section showing a base plate and element substrates according to the conventional method.
Figure 10B:
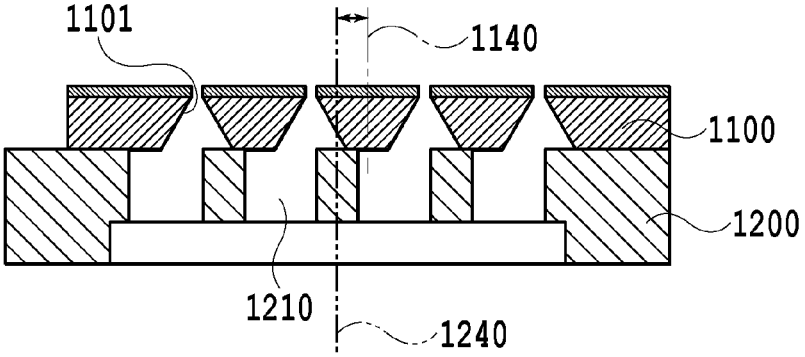
FIG.10B PRIOR ART
FIG. 10B is a cross section showing the base plate and the element substrates according to the conventional method.
Figure 10C:
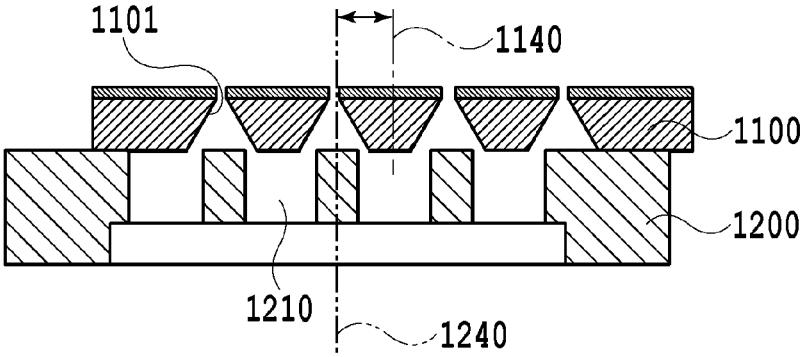
FIG.10C PRIOR ART
FIG. 10C is a cross section showing the base plate and the element substrates according to the conventional method.

FIG. 10A to FIG. 10C are cross sections taken along a direction of arrows X-X in FIG. 8B when the element substrates 1100 are attached and fixed to the base plate 1200 without adopting the method according to the present embodiment of the present invention. FIG. 10A shows the best joint state where the first center line 1140 of the element substrate 1100 is in agreement with the second center line 1240 of the ink supply line group 1215. FIG. 10B shows a joint state where the first center line 1140 of the element substrate 1100 and the second centerline 1240 of the ink supply line group 1215 are permitted to be shifted from each other by less than a half of a width dimension of the ink supply slit 1210 in the sheet conveying direction.

In this state, securement of an opening area between the ink supply opening 1101 and the ink supply slit 1210 and reliability on leakage or the like of an adherent at the jointing between the element substrate 1100 and the base plate 1200 can be maintained. FIG. 10C shows a joint state where the first center line 1140 of the element substrate 1100 and the second center line 1240 of the ink supply line group 1215 are shifted from each other by a half or more of a width dimension of the ink supply slit 1210 in the sheet conveying direction. In this state, the ink supply opening 1101 and the ink supply slit 1210 are largely shifted from each other, therefore making it impossible to secure the ink flow passage and maintain the reliability on leakage or the like of the adherent at the jointing between the element substrate 1100 and the base plate 1200.

According to the manufacturing method in the present embodiment of the present invention, in the arrangement configuration thus requiring the high accuracy, the element substrate 1100 can be arranged following the position of the ink supply slit 1210 in the sheet conveying direction. Therefore it is possible to realize the liquid ejection head with high reliability in which in regard to all the element substrates 1100, the positional shift between the element substrate 1100 and the ink supply slit 1210 does not nearly exist as shown in FIG. 10A.

Thereby it is possible to realize the method for manufacturing the liquid ejection head with high reliability that can prevent a deterioration in production yield rate at the manufacturing of the liquid ejection head to perform a cost decrease in production thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-023562, filed Feb. 10, 2014, which is hereby incorporated by reference herein in its entirety.

What is claimed is:

1. A method for manufacturing a liquid ejection head including a joint step for joining a base plate provided with a plurality of supply slits arranged at predetermined positions and an element substrate provided with a plurality of supply openings arranged to be adjusted relative to the predetermined positions, comprising:

an obtaining step for obtaining information in regard to a shift amount between the positions of the supply openings and the positions of the supply slits at the time of joining the element substrate and the base plate;

a correcting step for, in a case where the information in regard to the shift amount between the positions of the supply openings and the positions of the supply slits is a predetermined value or more, correcting a position of the element substrate such that the information in regard to the shift amount becomes less than the predetermined value; and a position correcting step for correcting the position of the element substrate by an integral multiple of an image formation minimum pixel pitch in a conveying direction of a sheet.

2. The method for manufacturing a liquid ejection head according to claim 1, each of the supply openings has a predetermined length corresponding to a length of each of the supply slits in a longitudinal direction, and the shift amount between the positions of the supply openings in the element substrate and the positions of the supply slits in the base plate is a shift amount between a center line of one of the supply openings along the longitudinal direction and a center line of a corresponding one of the supply slits along a longitudinal direction.

3. The method for manufacturing a liquid ejection head according to claim 1, wherein the predetermined value is a half of a width dimension of the supply slit in a short direction.

4. The method for manufacturing a liquid ejection head according to claim 1, further comprising:

a step for arranging a plurality of element substrates in a direction crossing the sheet conveying direction.

5. The method for manufacturing a liquid ejection head according to claim 1, further comprising:

a step for arranging a plurality of element substrates in the sheet conveying direction.

* * * * *